US008950743B2

(12) United States Patent
Sakano et al.

(10) Patent No.: US 8,950,743 B2
(45) Date of Patent: Feb. 10, 2015

(54) AUTOMATIC DOCUMENT FEEDER, IMAGE READING DEVICE INCLUDING THE SAME, AND IMAGE FORMING APPARATUS INCLUDING THE SAME

(71) Applicants: Koki Sakano, Kanagawa (JP); Hiroshi Kubo, Kanagawa (JP); Shinya Kitaoka, Kanagawa (JP); Takeshi Akai, Kanagawa (JP); Hidehiko Fujiwara, Tokyo (JP); Atsushi Kanaya, Kanagawa (JP); Fumiyuki Heishi, Kanagawa (JP); Takuya Sano, Kanagawa (JP)

(72) Inventors: Koki Sakano, Kanagawa (JP); Hiroshi Kubo, Kanagawa (JP); Shinya Kitaoka, Kanagawa (JP); Takeshi Akai, Kanagawa (JP); Hidehiko Fujiwara, Tokyo (JP); Atsushi Kanaya, Kanagawa (JP); Fumiyuki Heishi, Kanagawa (JP); Takuya Sano, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 14/069,507

(22) Filed: Nov. 1, 2013

(65) Prior Publication Data

US 2014/0125007 A1 May 8, 2014

(30) Foreign Application Priority Data

Nov. 6, 2012 (JP) ..... 2012-244696

(51) Int. Cl.
*B65H 83/00* (2006.01)
*B65H 7/20* (2006.01)
*B65H 7/02* (2006.01)

(52) U.S. Cl.
CPC ... *B65H 7/20* (2013.01); *B65H 7/02* (2013.01)
USPC ..... 271/3.14; 399/367

(58) Field of Classification Search
CPC . B65H 2801/06; G03G 15/60; H04N 1/00551
USPC ..... 271/3.14; 399/367, 380
See application file for complete search history.

(56) References Cited

U.S. PATENT DOCUMENTS

| | | | | |
|---|---|---|---|---|
| 5,058,877 | A | 10/1991 | Fujiwara et al. | |
| 5,638,181 | A | 6/1997 | Kubo et al. | |
| 5,971,388 | A | 10/1999 | Hattori et al. | |
| 6,091,927 | A | 7/2000 | Hattori et al. | |
| 8,380,088 | B2 * | 2/2013 | Oh | 399/9 |
| 2002/0054374 | A1 | 5/2002 | Inoue et al. | |
| 2004/0004319 | A1 | 1/2004 | Hattori et al. | |
| 2005/0179963 | A1 | 8/2005 | Nagano et al. | |
| 2007/0264063 | A1 | 11/2007 | Sano et al. | |
| 2008/0308995 | A1 | 12/2008 | Tobinaga et al. | |
| 2010/0027081 | A1 | 2/2010 | Sano et al. | |

(Continued)

FOREIGN PATENT DOCUMENTS

JP 2011-191630 9/2011

*Primary Examiner* — Michael McCullough
(74) *Attorney, Agent, or Firm* — Harness, Dickey & Pierce, P.L.C.

(57) ABSTRACT

According to an embodiment, an ADF that feeds and conveys original document sheets one sheet by one sheet from a tray unit to a read position on a document glass by motive power from a driving motor includes: an opening/closing unit operable to open and close relative to the document glass; an open/close detection sensor that detects an open/closed state of the opening/closing unit; a first interlock switch, which is arranged between a power source and the driving motor, that is on when the opening/closing unit is closed, and vice versa; and a control circuit that determines the open/closed state of the opening/closing unit based on detection outputs of the first interlock switch and the open/close detection sensor. The control circuit determines that the opening/closing unit is in the closed state when the first interlock switch is on and the open/close detection sensor is detecting the closed state.

8 Claims, 9 Drawing Sheets

(56) References Cited

U.S. PATENT DOCUMENTS

| | | | |
|---|---|---|---|
| 2010/0225045 | A1 | 9/2010 | Kimura et al. |
| 2010/0225983 | A1 | 9/2010 | Fujii et al. |
| 2011/0304092 | A1 | 12/2011 | Kambayashi et al. |
| 2012/0002252 | A1 | 1/2012 | Kubo et al. |
| 2012/0057212 | A1 | 3/2012 | Tobinaga et al. |
| 2012/0119432 | A1 | 5/2012 | Kambayashi et al. |
| 2012/0119436 | A1 | 5/2012 | Morita et al. |
| 2012/0314267 | A1 | 12/2012 | Suzuki et al. |
| 2013/0215481 | A1 | 8/2013 | Hayasaka et al. |

* cited by examiner

AUTOMATIC DOCUMENT FEEDER, IMAGE READING DEVICE INCLUDING THE SAME, AND IMAGE FORMING APPARATUS INCLUDING THE SAME

CROSS-REFERENCE TO RELATED APPLICATIONS

The present application claims priority to and incorporates by reference the entire contents of Japanese Patent Application No. 2012-244696 filed in Japan on Nov. 6, 2012.

BACKGROUND OF THE INVENTION

1. Field of the Invention

The present invention relates generally to an automatic document feeder (ADF), an image reading device including the ADF, and an image forming apparatus including the ADF. More particularly, the invention relates to an ADF that automatically conveys original document sheets one sheet by one sheet from a stack of the document sheets placed on a document tray, an image reading device and an image forming apparatus such as a facsimile, a copier, a multifunction peripheral including the ADF.

2. Description of the Related Art

This type of automatic document feeder generally employs a DC motor as a driving source. This is because using a DC motor as the driving source allows reducing power consumption as compared with using an AC motor as the driving source.

Such an ADE typically adopts a safety measure e.g., blocking power supply to a DC motor at jam recovery. More specifically, in such an ADF, an original document (hereinafter, "document") can be jammed into a component (e.g., a conveying roller), causing paper jam (document jam) to occur. Causes of the paper jam include a stapled document, a bent document, and variation in document type, such as a size, a thickness, or a material. When paper jam occurs, a user performs so-called jam recovery in which a user opens a document feed cover of the ADF and removes a jammed document. An ADF generally includes an open/close detection sensor that detects an open/closed state of the document feed cover. During jam recovery, power supply to the DC motor is blocked in response to detecting that the document feed cover is in the open state based on a detection output of the open/close detection sensor. As a result, a user can perform jam recovery safely.

Meanwhile, in a conventional ADF, there can occur a situation that a document feed cover is not completely closed, or, in other words, a semi-locked state (halfway-closed state) can occur.

There is disclosed an ADE that detects occurrence of such a semi-locked state using an open/close detecting unit and a document-loading detecting unit to thereby increase accuracy in detecting a semi-locked state of a top cover. An example of such an ADF is disclosed in Japanese Laid-open Patent Application No. 2011-191630.

The ADF disclosed in Japanese Laid-open Patent Application No. 2011-191630 is configured to detect an open/closed state of the top cover at two positions by arranging, in a main body of the ADF, the open/close detecting unit on one side in an axial direction of a rotary shaft of the top cover and the document-loading detecting unit on the other side.

Adopting an interlock switch that blocks power supply to the driving source when an opening/closing unit is opened can increase safety level. However, in an ADF adopting such an interlock switch, when results of open/close detection disagree between the open/close detection sensor and the interlock switch, an erroneous determination can be made that, for example, a machine anomaly has occurred.

The open/close detection sensor is configured to detect an open state of the opening/closing unit and, upon detection of the open state, the ADE is brought to a standby mode where the ADF is deactivated. The interlock switch is switched off when the opening/closing unit is open, and blocks power supply to the driving source.

More specifically, mounting the interlock switch on the ADF allows blocking power supply to the driving source immediately when the opening/closing unit is opened. As a result, user safety during jam recovery can be further increased.

However, combined use of the open/close detection sensor and the interlock switch can be disadvantageous in the following way. In a situation where, for instance, the interlock switch is off even though the opening/closing unit is detected as being in the closed state according to a detection output of the open/close detection sensor, whereas a notification about the closed state (i.e., exit from the standby mode) according to the open/close detection sensor is sent to a user, power supply to the driving source is blocked by the interlock switch. As a result, it is occurred an abnormal condition in which the ADF does not operate even though the opening/closing unit is closed.

As described above, when both the open/close detection sensor and the interlock switch that blocks power supply to the driving source when the opening/closing unit is opened are mounted on the ADF, the ADF can be misjudged as being possibly anomalous in a case where the open/closed state of the opening/closing unit is erroneously detected.

In light of the foregoing, there is a need for an ADE capable of resolving a trouble that can occur when both the open/close detection sensor and the interlock switch are mounted on the ADF and that arises from erroneous detection of the open/closed state of the opening/closing unit, thereby increasing reliability of the ADF, an image reading device including the ADF, and an image forming apparatus including the same.

It is an object of the present invention to at least partially solve the problem in the conventional technology.

SUMMARY OF THE INVENTION is an object of the present invention to at least partially solve the problems in the conventional technology.

According to the present invention, there is provided: an automatic document feeder that includes a document tray unit on which original document sheet are placed and feeds the original document sheets placed on the document tray unit one sheet by one sheet and conveys the document sheet to a predetermined read position on a document glass by motive power supplied from a driving motor, the automatic document feeder comprising: an opening/closing unit configured to be operable to open and close relative to the document glass; an open/close detection sensor configured to detect an open/closed state of the opening/closing unit; a first interlock switch arranged between a power source and the driving motor, the first interlock switch being configured to be on when the opening/closing unit is in the closed state and be off when the opening/closing unit is in the open state; and a control circuit configured to determine the open/closed state of the opening/closing unit based on a detection output of the first interlock switch and a detection output of the open/close detection sensor, wherein the control circuit determines that the opening/closing unit is in the closed state when the first interlock switch is on and the open/close detection sensor is detecting the closed state.

The present invention also provides an image reading device comprising a document glass and an automatic document feeder that includes a document tray unit on which original document sheets are placed and feeds the original document sheets placed on the document tray unit one sheet by one sheet and conveys the document sheet to a predetermined read position on the document glass by motive power supplied from a driving motor.

In the above-mentioned image reading device, the automatic document feeder comprising: an opening/closing unit configured to be operable to open and close relative to the document glass; an open/close detection sensor configured to detect an open/closed state of the opening/closing unit; a first interlock switch arranged between a power source and the driving motor, the first interlock switch being configured to be on when the opening/closing unit is in the closed state and be off when the opening/closing unit is in the open state; and a control circuit configured to determine the open/closed state of the opening/closing unit based on a detection output of the first interlock switch and a detection output of the open/close detection sensor, wherein the control circuit determines that the opening/closing unit is in the closed state when the first interlock switch is on and the open/close detection sensor is detecting the closed state.

The present invention also provides an image forming apparatus comprising an image reading device including a document glass and an automatic document feeder that includes a document tray unit on which original document sheets are placed and feeds the original document sheets placed on the document tray unit one sheet by one sheet and conveys the document sheet to a predetermined read position on the document glass by motive power supplied from a driving motor, and an image recording device that forms the document image on a recording paper sheet according to an image obtained from a document image on the document sheet by the image reading device.

In the above-mentioned image forming apparatus, the automatic document feeder comprising: an opening/closing unit configured to be operable to open and close relative to the document glass; an open/close detection sensor configured to detect an open/closed state of the opening/closing unit; a first interlock switch arranged between a power source and the driving motor, the first interlock switch being configured to be on when the opening/closing unit is in the closed state and be off when the opening/closing unit is in the open state; and a control circuit configured to determine the open/closed state of the opening/closing unit based on a detection output of the first interlock switch and a detection output of the open/close detection sensor, wherein the control circuit determines that the opening/closing unit is in the closed state when the first interlock switch is on and the open/close detection sensor is detecting the closed state.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An exemplary embodiment of an automatic document feeder (ADF) according to the present invention is described below with reference to the accompanying drawings.

Figure 1:
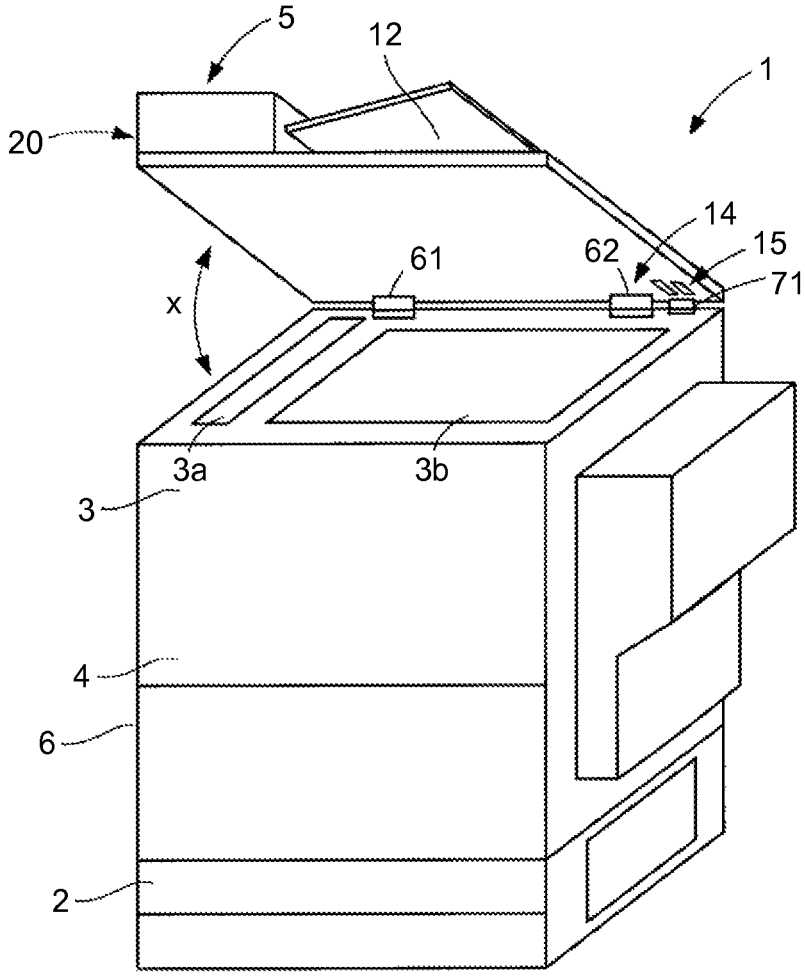
FIG. 1 is a perspective view illustrating an entire configuration of a copier including an ADF according to an embodiment of the present invention.

FIG. 1 illustrates an example of an image forming apparatus including the ADF, the image forming apparatus being embodied as a copier 1.

More specifically, this copier 1 includes a paper-sheet feed device 2, an image reading device 3, an image recording device 4, an ADF 5, and a housing 6 that accommodates these components.

The paper-sheet feed device 2 is configured to perform so-called "automatic paper-sheet feeding" of supplying recording paper sheets to the image recording device 4. The paper-sheet feed device 2 includes a media cassette and a paper-sheet feed conveying mechanism, which are not illustrated. The media cassette is configured to be capable of storing recording paper sheets of different sizes. The paper-sheet feed conveying mechanism includes a plurality of conveying rollers and is configured to convey the recording paper sheets stored in the media cassette one by one to an image forming position of the image recording device 4.

The image reading device 3 includes a slit glass 3*a*, an exposure glass 3*b*, a carriage (not shown), an imaging lens (not shown), and an image capturing unit (not shown). A light source and a mirror are mounted on the carriage. The image reading device 3 is configured to obtain a read image from a document image on a surface of an original document by performing optical reading. That is, the light source on the carriage emits light through the slit glass (document glass) 3*a* onto the to-be-read document that is conveyed by the ADF 5 at a predetermined velocity; the mirror on the carriage redirects light reflected from the document; the imaging lens converges the redirected reflection light so that an image is formed on the image capturing unit.

The image recording device 4 includes an exposure unit, a photosensitive drum, a developing unit, a transfer belt, and a fixing unit, which are not illustrated. The image recording device 4 is configured to operate as follows. The exposure unit forms a latent image on the photosensitive drum by exposing the photosensitive drum to light according to the read image obtained by the image capturing unit of the image reading device 3. The developing unit supplies toner of different colors to develop the latent image formed on the photosensitive drum. The transfer belt transfers the developed toner image on the photosensitive drum onto a recording paper sheet fed from the paper-sheet feed device 2. Thereafter, the fixing unit fuses toner of the transfer image transferred onto the recording paper sheet, thereby fixing a color or monochrome document image onto the recording paper sheet. The image recording device 4 also includes a sheet-ejecting-and-conveying mechanism (not shown) that conveys the recording paper sheet, onto which the document image has been fixed, from the image forming position to the outside of the copier 1.

The ADF 5 is arranged above the image reading device 3 to be operable to open and close in directions indicated by arrow x in FIG. 1. The ADF 5 is configured to automatically pick up document sheets one sheet by one sheet from a stack of the document sheets (hereinafter, "document stack") loaded in the ADF 5 and conveys the document sheet to the image reading device 3. The ADF 5 includes a pressure plate unit (opening/closing unit) 20 functioning as a lift-up unit that presses a manually-placed book or original document into pressure contact with the exposure glass 3*b*, an opening/closing mechanism unit 14 for opening and closing the pressure plate unit 20, and an open/close detecting unit 15. More specifically, the ADF 5 is attached to the housing 6 to be operable to open and close via the opening/closing mechanism unit 14 in such a manner that the pressure plate unit 20 faces a reading surface of the image reading device 3.

Figure 2:
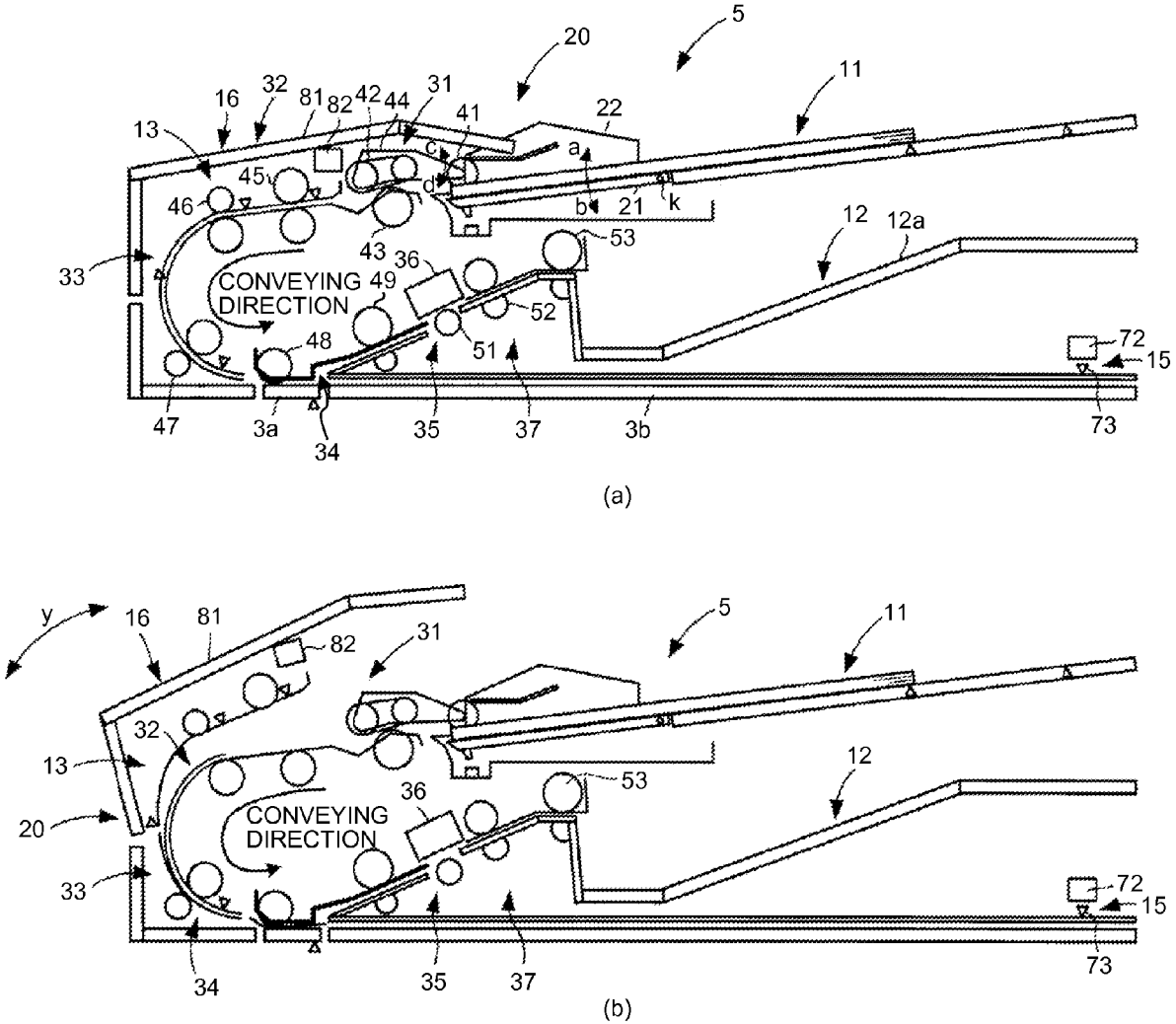
FIGS. 2(*a*) and 2(*b*) are configuration schematics of the ADF according to the embodiment, FIG. 2(*a*) being a cross-sectional view illustrating a state where a document-feed cover unit is closed, FIG. 2(*b*) being a cross-sectional view illustrating a state where the document-feed cover unit is open.

FIGS. 2(*a*) and 2(*b*) illustrate an example configuration of the ADF 5.

As illustrated in FIG. 2(*a*), the pressure plate unit 20 includes a document tray unit (document loading unit) 11 where a document stack is to be placed, an ejected-document tray unit (document ejection unit) 12 that accommodates read and thereafter ejected document sheets, a document conveying unit 13 that conveys the document sheet, a drive-system motor M that drives corresponding components, and a document-feed cover unit 16. The ADF 5 is configured to operate as follows. A sheet of a document stack placed on the document tray unit 11 is automatically conveyed by the document conveying unit 13 to a read position on the slit glass 3*a*. The image reading device 3 reads a document image through the slit glass 3*a*. Thereafter, the document sheet is ejected to be accommodated in the ejected-document tray unit 12.

The copier 1 can perform the document image reading described above on a book or a document that is stationary on the reading surface of the image reading device 3 by performing operations including: manually opening the pressure plate unit 20 of the ADF 5; placing the book or the document on the exposure glass 3*b* of the image reading device 3; and thereafter manually closing the pressure plate unit 20. However, details of the operations are omitted. The ADF 5 does not necessarily automatically convey a document stack, and may convey a single sheet of a document (in other words, only a single document sheet, rather than a document stack, can be placed on the document tray unit 11 of the ADF 5).

The document tray unit 11 includes a movable document table 21, and a pair of side guides 22 arranged on left and right sides with respect to a document conveying direction. The movable document table 21 is substantially a front half portion of the document tray unit 11 in the document feed direction. The movable document table 21 is configured to move in directions indicated by arrow a and b in FIG. 2A about a pivot point, or a basal end portion k, thereby adjusting a front end in the conveying direction of the document stack on the document tray unit 11 to an appropriate height. The document stack is placed on the document tray unit 11 with a front side (the side of a document image) of each document sheet facing up.

The side guides 22 are configured so as to regulate a length (e.g., document width) of the document stack on the document tray unit 11 in a lateral direction relative to the document conveying direction. One (or both) of the pair of side guides 22 is slidable in the lateral direction relative to the conveying direction so that document stacks of different sizes can be placed on the document tray unit 11.

A plurality of sensors, that detects a document-stack loading state, whether or not document sheets are of a same size, a document orientation, and the like, are arranged on the document tray unit 11.

The ejected-document tray unit 12 includes a tray 12*a* arranged below the document tray unit 11. Document sheets that have been conveyed and ejected by the document conveying unit 13 are sequentially overlaid on one another to be accommodated in the tray 12*a*.

The document conveying unit 13 includes a separating-and-delivery unit 31, a pullout unit (registration unit) 32, a turnover unit (turnover section) 33, a first read-conveying unit (first read-conveying section) 34, a second read-conveying unit 35, a reading unit 36, and a document ejecting unit (document ejecting-and-stacking section) 37.

A variety of sensors are arranged at various positions in the document conveying unit 13 to detect a conveying position(s) and a conveying velocity of a document, operation timing of components of the units, and the like.

The separating-and-delivery unit 31 includes a pickup roller 41, a document feed belt 42, a reverse roller 43, and a support arm 44. The pickup roller 41 is supported by the support arm 44 and configured to move up and down via a cam mechanism (not shown) in directions indicated by arrows c and d in FIG. 2(*a*) between a contact position where the pickup roller 41 contacts a document stack and a distant position where the pickup roller 41 is separated from the document stack. The pickup roller 41 is configured to pick up the document stack on the document tray unit 11 one sheet by one sheet at the contact position.

The ADF 5 may include one, rather than both, of the pickup roller 41 and the movable document table 21.

The document feed belt 42 is rotatable in the conveying direction and configured to be movable up and down between a contact position where the document feed belt 42 contacts the reverse roller 43 and a distant position where the document feed belt 42 is separated from the reverse roller 43. The reverse roller 43 is configured to rotate in and opposite to the document conveying direction. More specifically, when multiple document sheets overlaid on one another are to be fed, or, in short, when multiple feed will occur, the reverse roller 43 rotates in the opposite direction while being pressed with a predetermined pressure into contact with the document feed belt 42. As a result, multiple feed of the document is prevented.

Meanwhile, the reverse roller 43 is configured to be rotated by rotation of the document feed belt 42 by an action of a torque limiter (not shown) that acts when the reverse roller 43 is in direct contact with the document feed belt 42 or conveying only a single sheet of document.

The pullout unit 32 includes a conveying path and a pair of pullout rollers 45 arranged with the conveying path therebetween. The pullout unit 32 is configured to perform primary document alignment (what is referred to as "skew correction") by delivering a leading end of a document conveyed by the document feed belt 42 into a nip between the pullout rollers 45. The pullout rollers 45 are configured to convey the skew-corrected document toward the slit glass 3*a* of the image reading device 3.

The turnover unit 33 includes a curved conveying path that extends curvedly from upper-stream to down stream near the pressure plate unit 20. The turnover unit 33 also includes a pair of intermediate rollers 46 and a pair of read entry rollers 47, each pair of which is arranged to sandwich the curved conveying path therebetween. The turnover unit 33 is configured to turn over the document pulled out and conveyed by the intermediate rollers 46 by conveying the document along the curved conveying path, and convey the document with its front side facing down to near the slit glass 3*a* using the read entry rollers 47.

The turnover unit 33 allows reducing time necessary for conveying a document to the first read-conveying unit 34 by conveying the document at a high velocity or, more specifically, by conveying the document in the turnover unit 33 at a velocity higher than a velocity at which the document is conveyed in the first read-conveying unit 34, for example.

The first read-conveying unit 34 includes a reading roller 48, which is arranged at the read position where the reading roller 48 faces the slit glass 3*a* across the conveying path, and a pair of read exit rollers 49 arranged downstream of the read position to sandwich the conveying path therebetween. The first read-conveying unit 34 is configured to operate as follows. The reading roller 48 conveys the document, which has been conveyed to near the slit glass 3*a*, at the predetermined velocity while maintaining the front side of the document in contact with the slit glass 3*a*. The read exit rollers 49 convey the read document further downstream in the conveying direction.

The second read-conveying unit 35 includes a reading roller 51, which is arranged at a position to face the reading unit 36 across the conveying path, and a pair of read exit rollers (contact image sensor (CIS) exit rollers) 52, which is arranged downstream of the reading unit 36 in the conveying direction. In the second read-conveying unit 35, the read exit rollers 52 convey the document passed beneath the reading unit 36 toward the document ejecting unit 37. The second read-conveying unit 35 and the reading unit 36 make up a second read-conveying station. The reading roller 51 also serves as a reference white portion for use in obtaining shading data in the second read-conveying station.

The reading unit 36 comprises a CIS (Contact Image Sensor) including a photoelectric transducer, such as a charge coupled device (CCD) or a complementary metal oxide semiconductor (CMOS). The reading unit 36 is configured to read a back side of a document, of which original image on the front side has been read by the image reading device 3 through the slit glass 3*a*, to perform so-called duplex reading. The reading unit 36 is configured to cause a document to pass beneath the reading unit 36 with no processing when duplex reading is not to be performed.

The document ejecting unit 37 includes a pair of document ejecting rollers 53 that are arranged so as to place the conveying path therebetween. The document ejecting unit 37 is configured to eject the document conveyed by the read exit rollers 52 onto the tray 12*a* of the ejected-document tray unit 12.

The document-feed cover unit 16 includes a document feed cover 81 and an interlock switch (second interlock switch) 82 arranged on an inner wall of the document feed cover 81. The document feed cover 81 is arranged so as to cover the separating-and-delivery unit 31, the pullout unit 32, and the turnover unit 33. The document feed cover 81 includes a handle and an opening/closing mechanism, which are not illustrated, for supporting the document feed cover 81 in a manner that allows the document feed cover 81 to open and close.

As illustrated in FIG. 2(*b*), the document-feed cover unit 16 is operable to open and close in directions indicated by an arrowed line y in FIG. 2(*b*). The document-feed cover unit 16 has a configuration that allows performing jam recovery, when a document being conveyed is jammed into a component, such as a roller of the separating-and-delivery unit 31, the pullout unit 32, or the turnover unit 33, in which a user opens the document feed cover 81 and removes the jammed document. The interlock switch 82 detects an open/closed state of the document feed cover 81. When the interlock switch 82 detects that the document feed cover 81 is in the open state, electric power, that is supplied to the drive-system motor M for driving components, such as rollers of the units that make up the document conveying unit 13, is interrupted (blocked). As a result, user safety during jam recovery is ensured.

Figure 3:
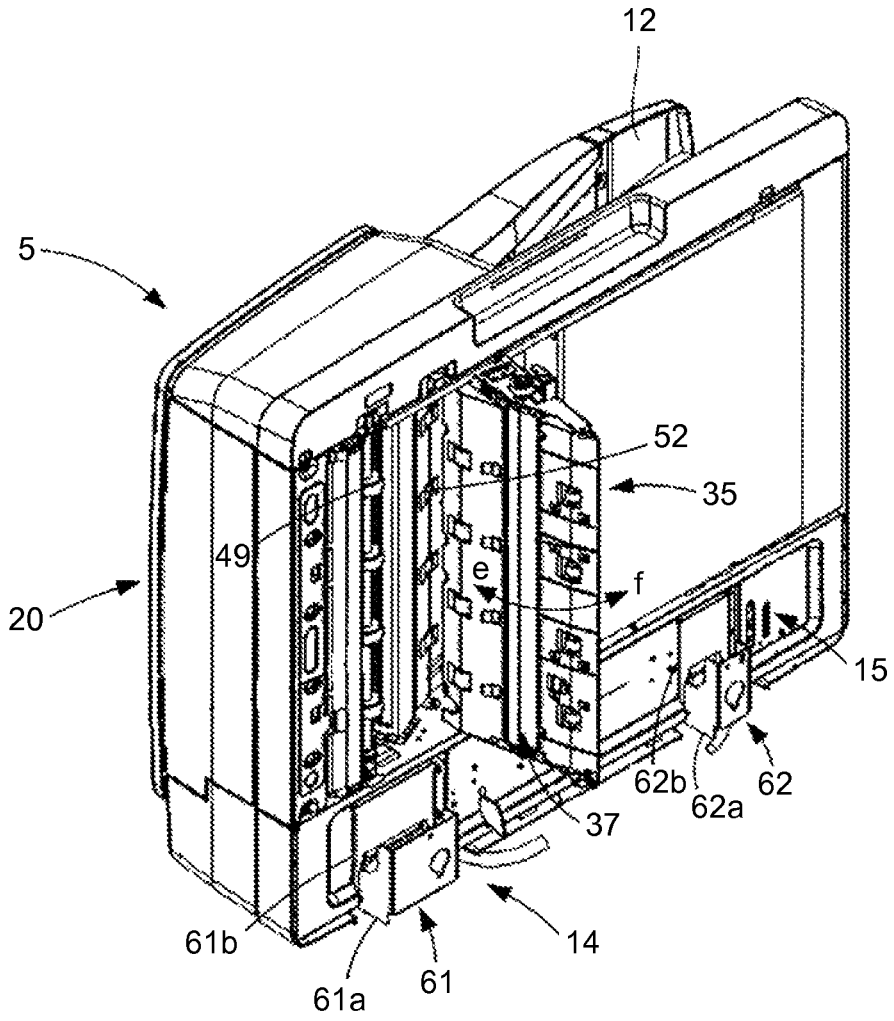
FIG. 3 is a perspective view illustrating a configuration of the ADF according to the embodiment as viewed from a bottom side.

FIG. 3 illustrates an example configuration of the ADF 5 as viewed from a bottom side where the ADF 5 faces to the image reading device 3.

As illustrated in FIG. 3, the ADF 5 is configured so that the second read-conveying unit 35 can be opened and closed in directions indicated by arrowed lines e and f in FIG. 3 about a rotation axis (not shown) in a state where the pressure plate unit 20 is open. More specifically, the ADF 5 is configured so that, even when a document is jammed into a component such as a roller of the first read-conveying unit 34 or the second read-conveying unit 35, a user can perform jam recovery by opening the second read-conveying unit 35 and removing the jammed document.

As illustrated in FIG. 3, the opening/closing mechanism unit 14 for allowing the pressure plate unit 20 to open and close includes a first hinge 61 and a second hinge 62.

The first hinge 61 includes a housing-anchored piece 61*a* anchored onto the housing 6, a pressure-plate-anchored piece 61*b* anchored onto the pressure plate unit 20 via the housing-anchored piece 61*a*, and a compression coil spring (not shown). The compression coil spring is housed in the pressure-plate-anchored piece 61*b*.

As does the first hinge 61, the second hinge 62 includes a housing-anchored piece 62*a* fixed onto the housing 6, a pressure-plate-anchored piece 62*b* fixed onto the pressure plate unit 20 via the housing-anchored piece 62*a*, and a compression coil spring (not shown). The compression coil spring is housed in the pressure-plate-anchored piece 62*b*.

Figure 4:
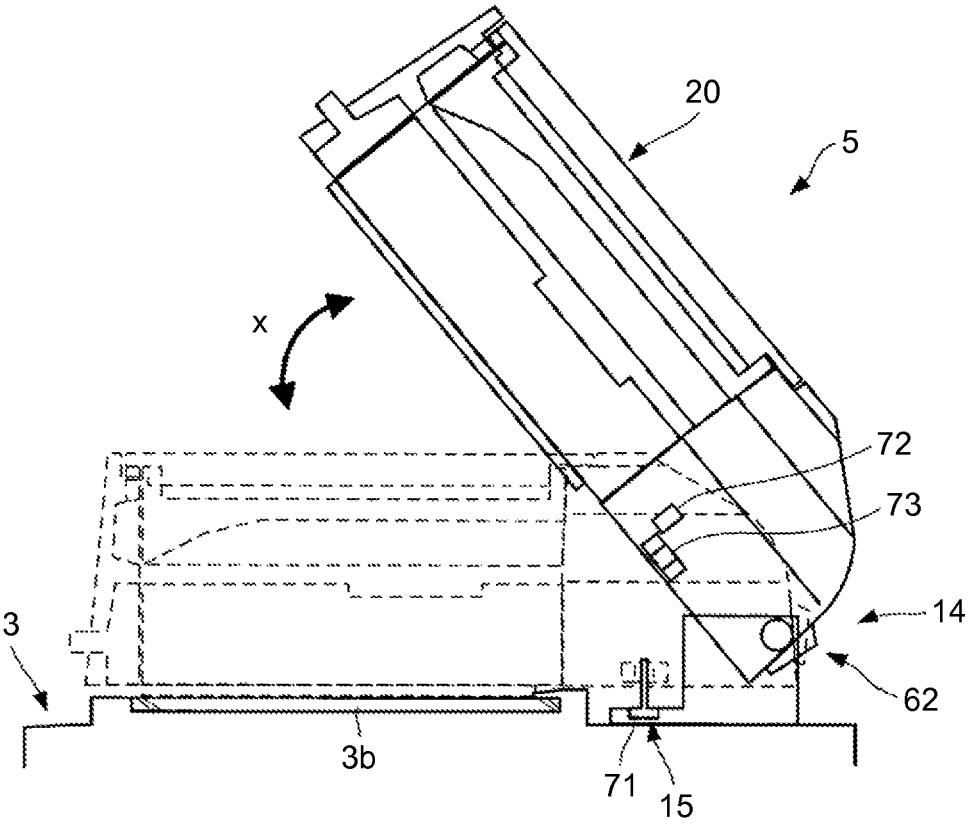
FIG. 4 is a side view of the ADF according to the embodiment, illustrating a state where a pressure plate unit of the ADF is open.

As illustrated in FIG. 4, the opening/closing mechanism unit 14 is configured so that, when the pressure plate unit 20 is opened, the first hinge 61 and the second hinge 62 cooperate to thereby hold the pressure plate unit 20 at a desired angle relative to the exposure glass 3*b* of the image reading device 3.

Figure 5:
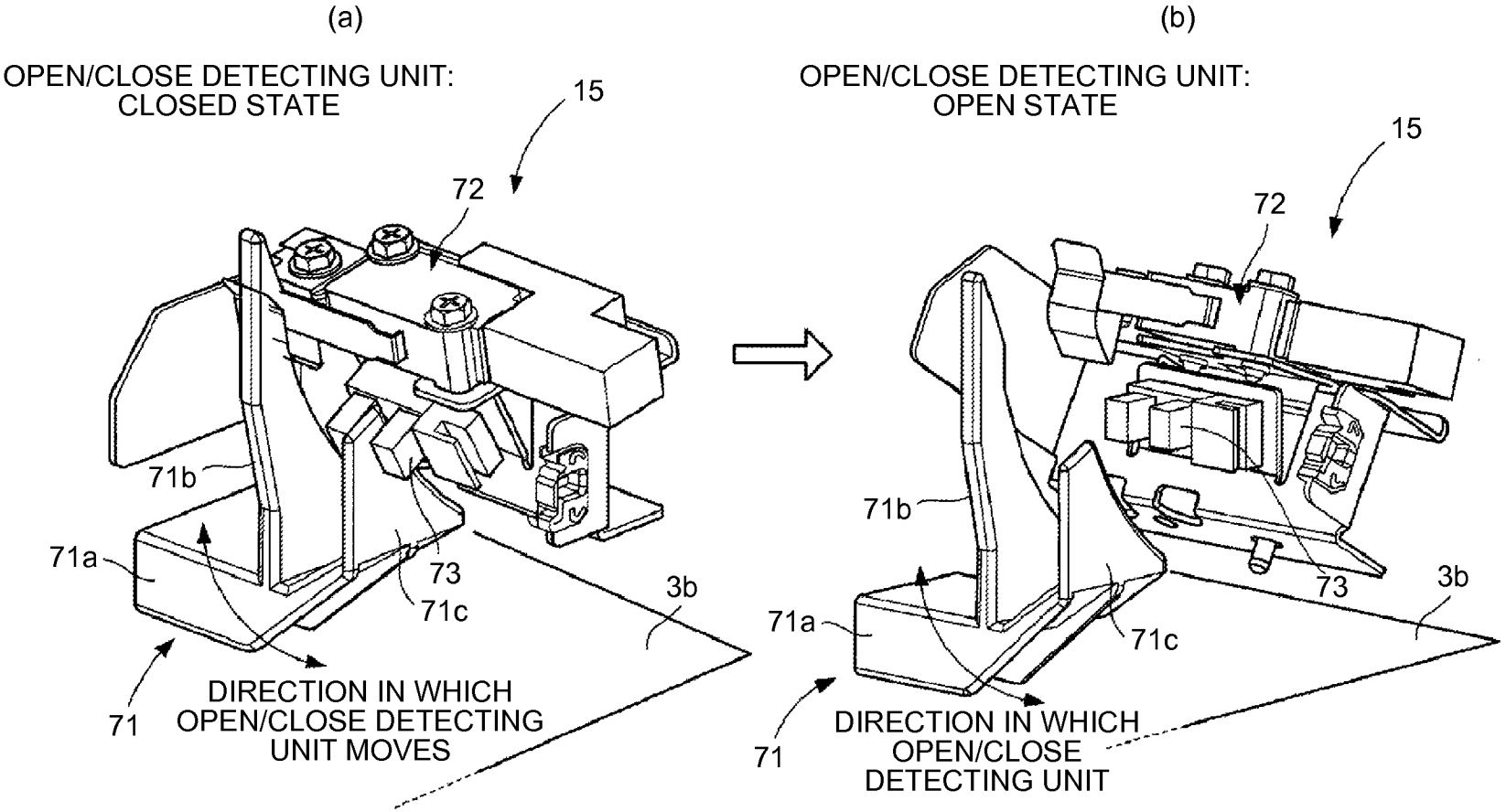
FIGS. 5(*a*) and 5(*b*) illustrate an open/close detecting unit of the ADF according to the embodiment, FIG. 5(*a*) being a perspective view illustrating a state where the pressure plate unit is closed, FIG. 5(*b*) being a perspective view illustrating a state where the pressure plate unit is open.

FIGS. 5(*a*) and 5(*b*) illustrate an example configuration of the open/close detecting unit 15 arranged near the second hinge 62 of the opening/closing mechanism unit 14.

As illustrated in FIGS. 5(*a*) and 5(*b*), the open/close detecting unit 15 includes a plate 71, an interlock switch (first interlock switch) 72 for the pressure plate unit 20, and an open/close detection sensor 73 for the pressure plate unit 20.

The plate 71 includes a base plate 71*a* fixed onto the housing 6, a pressing plate 71*b* projecting from the base plate 71*a* toward the pressure plate unit 20, and a blocking plate 71*c* projecting from the base plate 71*a* toward the pressure plate unit 20. The pressing plate 71*b* is pressed against the interlock switch 72 when the pressure plate unit 20 is in the closed state. The blocking plate 71*c* blocks the open/close detection sensor 73 (causes the sensor 73 to switch on) when the pressure plate unit 20 is in the closed state. The blocking plate 71*c* is formed at a predetermined distance away from the pressing plate 71*b*.

The interlock switch 72 is configured to operate as follows. When the pressure plate unit 20 is closed, the pressing plate 71*b* of the plate 71 presses an arm, whereby a contact member 72*c* (FIG. 6) is switched on (placed in a connecting position). When, reversely, the pressure plate unit 20 is opened, the arm is released from being pressed by the pressing plate 71*b*, whereby the contact member 72*c* is switched off (placed in a disconnecting position).

The open/close detection sensor 73 comprises a photodetector, such as a transmissive photodetector, and is configured to operate with the interlock switch 72 depending on the open/closed state of the pressure plate unit 20.

The open/close detection sensor 73 is configured to be switched on and off as follows, for example. When the pressure plate unit 20 is closed, the blocking plate 71*c* blocks a relay (a detecting unit 73*c*) of the open/close detection sensor 73, whereby the open/close detection sensor 73 is switched on. When the pressure plate unit 20 is opened, the blocking plate 71*c* unblocks the relay of the open/close detection sensor 73, whereby the open/close detection sensor 73 is switched off.

Ideally, when the pressure plate unit 20 is closed, the interlock switch 72 is pressed by the pressing plate 71*b* to be switched on first; subsequently, the blocking plate 71*c* blocks the relay of the open/close detection sensor 73, thereby the sensor is switched on. When, reversely, the pressure plate unit 20 is opened, the blocking plate 71*c* unblocks the relay of the open/close detection sensor 73, thereby the sensor 73 is switched off first; subsequently, the interlock switch 72 is released from being pressed by the pressing plate 71*b* to be switched off.

By arranging the interlock switch 72 and the open/close detection sensor 73 in proximity to each other, it becomes possible to prevent disagreement, due to a semi-locked state or the like, between a detection output of the interlock switch 72 and a detection output of the open/close detection sensor 73 in detection of the open/closed state of the pressure plate unit 20.

Figure 6:
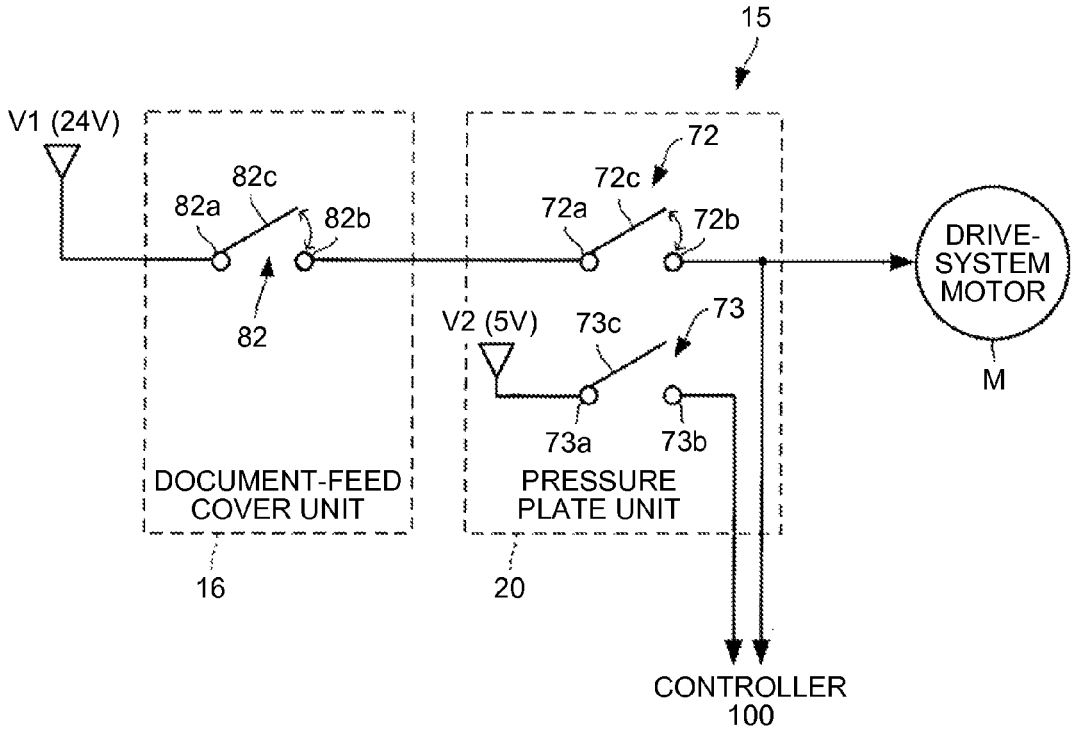
FIG. 6 is a circuit diagram for describing a relation between interlock switch and open/close detection sensor of the ADF according to the embodiment.

FIG. 6 is a diagram illustrating a relation between the above-mentioned interlock switches 72 and 82 and the open/close detection sensor 73.

As illustrated in FIG. 6, the interlock switch 72 includes a terminal 72*a* on the power supply side (hereinafter, "the power-supply-side terminal 72*a*"), a terminal 72*b* on the side of the drive-system motor M, and the contact member 72*c* that operates to connect/disconnect (on/off) between the terminals 72*a* and 72*b* depending on the open/closed state of the pressure plate unit 20. The terminal 72*a* is connected via the interlock switch 82 to a first power source V1 (e.g., a first voltage of 24 volts DC), by which the drive-system motor M is driven. The terminal 72*b* is connected to the drive-system motor M and a controller 100 (to be described later using FIG. 7).

The interlock switch 82 includes a terminal 82*a* on the power supply side, a terminal 82*b* on the side of the drive-system motor M, and a contact member 82*c* that operates to connect/disconnect (on/off) between the terminals 82*a* and 82*b* depending on the open/closed state of the document feed cover 81 of the document-feed cover unit 16. The terminal 82*a* is connected to the first power source V1, by which the drive-system motor M is driven. The terminal 82*b* connected to the drive-system motor M via the interlock switch 72.

The interlock switch 82 is similar in configuration to the interlock switch 72 described above and configured to be controlled by a plate (not shown) in a similar manner. More specifically, the interlock switch 82 is configured to operate as follows. When the document feed cover 81 is in the open state, the contact member 82*c* is in an off position; when the document feed cover 81 is in the closed state, the contact member 82*c* is in an on position.

As described above, the downstream interlock switch 72 is configured to detect that the pressure plate unit 20 is in the closed state when the contact member 72*c* is in the on position, and that the pressure plate unit 20 is in the open state when the contact member 72*c* is in the off position. The upstream interlock switch 82 is configured to detect that the document feed cover 81 is in the closed state when the contact member 82*c* is in the on position, and that the document feed cover 81 is in the open state when the contact member 82*c* is in the off position.

The open/close detection sensor 73 includes a power-supply-side terminal 73*a*, a detection-side terminal 73*b*, and the detecting unit 73*c* that operates to connect/disconnect (on/off) between the terminals 73*a* and 73*b*.

The power-supply-side terminal 73*a* is connected to a second power source V2 (e.g., a second voltage of 5 volts DC). The detection-side terminal 73*b* is connected to the controller 100 described above.

More specifically, the open/close detection sensor 73 is configured to detect that the pressure plate unit 20 is in the closed state when the detecting unit 73*c* is blocked, and that the pressure plate unit 20 is in the open state when the detecting unit 73*c* is unblocked. The second voltage of 5 volts DC is supplied to the terminal 73*a* of the open/close detection sensor 73. Accordingly, the open/close detection sensor 73 is capable of detecting the open/closed state of the pressure plate unit 20 even in a state where the interlock switch 82 is switched off because the document feed cover 81 is in the open state, and therefore the first voltage of 24 volts DC is not supplied to the power-supply-side terminal 72*a* of the interlock switch 72.

Figure 7:
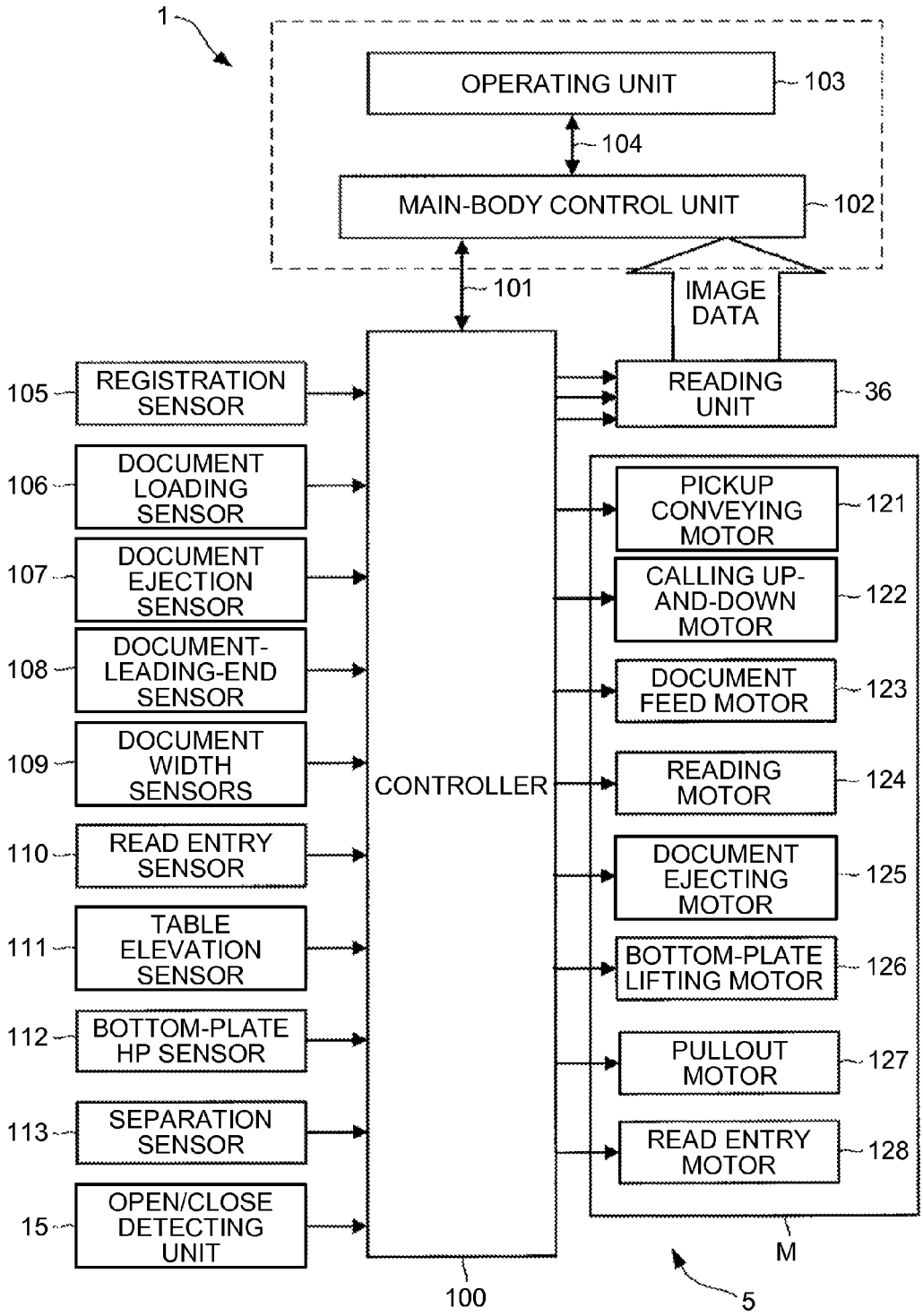
FIG. 7 is a block diagram illustrating a configuration of a control system of the ADF according to the embodiment.

FIG. 7 is a diagram illustrating an example configuration of a control system for controlling the ADF 5.

A main-body control unit 102 for controlling the entire copier 1 via an interface (I/F) circuit 101 is connected to a controller (control circuit) 100 that controls driving of the ADF 5. Connected to the main-body control unit 102 is an operating unit 103 to be operated by a user. The operating unit 103 includes an operation panel (notification unit) for displaying a message at occurrence of an anomaly and the like. A data bus 104 connects between the operating unit 103 and the main-body control unit 102.

Various sensors arranged at respective positions of the ADF 5 are connected to the controller 100. The sensors include a registration (document entry) sensor 105, a feeler pin or a document loading sensor 106, a document ejection sensor 107, a document-leading-end sensor 108, document width sensors 109 and a document length sensor (e.g., a sensor of a type that detects reflection light or an actuator type), a read entry sensor 110, a table elevation sensor 111, a bottom-plate home-position (HP) sensor 112, and a separation sensor 113.

The interlock switch 72 and the open/close detection sensor 73 of the open/close detecting unit 15 are also connected to the controller 100.

The reading unit 36 of the second read-conveying unit 35 is also connected to the controller 100. The controller 100 controls the reading unit 36 so that the reading unit 36 outputs image data (of an original image) obtained by reading a back side of a document, of which front side has been read by the image reading device 3, to the main-body control unit 102.

The drive-system motor M including a plurality of DC motors and/or the like for driving the components of the ADF 5 is also connected to the controller 100. The drive-system motor M includes, for example, a pickup conveying motor 121, a calling up-and-down motor 122, a document feed motor 123, a reading motor 124, a document ejecting motor 125, a bottom-plate lifting motor 126, a pullout motor 127, and a read entry motor 128.

The controller 100 is configured to control the drive-system motor M and the like based on information about an operation (such as a print-key operation) performed on the operating unit 103 fed from the main-body control unit 102 and outputs of the sensors so that a document is conveyed at a predetermined velocity.

The controller 100 is also configured to supply or block supply of the first power source V1 to the drive-system motor M based on a detection output (e.g., a voltage value) of the open/close detecting unit 15.

The bottom-plate lifting motor 126 is configured to lift and lower the movable document table 21 of the document tray unit 11. The pickup conveying motor 121 is configured to move up and down the pickup roller 41. The table elevation sensor 111 detects an upper limit position of the movable document table 21 that is lifted up.

More specifically, the pickup conveying motor 121 drives the pickup roller 41 under control of the controller 100 according to a document detection signal from the document loading sensor 106, a document feed signal fed from the main-body control unit 102 according to an operation performed on the print key on the operating unit 103, and the like.

Under control of the controller 100, the document feed motor 123 runs forward to rotate the document feed belt 42 in the document conveying direction and, simultaneously, rotate the reverse roller 43 in a direction opposite to the document conveying direction.

Under control of the controller 100, the document feed motor 123 drives the document feed belt 42 so as to send a document a predetermined distance from a position where the document-leading-end sensor 108 detects a leading end of the document and stop the document in a state where the leading end of the document is pressed against the pullout rollers 45.

Under control of the controller 100, the pullout motor 127 runs backward to drive the pullout rollers 45 so as to convey the skew-corrected document to the intermediate rollers 46. By driving the pullout rollers 45 using the pullout motor 127, which is an independent driving source, in this manner, motor startup time and motor stop time can be reduced, and therefore productivity can be enhanced.

The plurality of document width sensors 109 are arranged in the lateral direction relative to the document conveying direction to detect a size in the width direction of the document conveyed by the pullout rollers 45. The length of the document in the conveying direction is determined by the controller 100 based on, for instance, a motor pulse count corresponding to an output of the document-leading-end sensor 108.

When the read entry sensor 110 detects the leading end of the document, the controller 100 causes a conveying velocity of the document to decrease. Simultaneously, the controller 100 causes the read entry motor 128 to run forward, thereby causes the read entry rollers 47 to drive, and causes the reading motor 124 to run backward, thereby causes the read exit rollers 49 and the read exit rollers 52 to drive.

When the registration (document entry) sensor 105 detects the leading end of the document, the controller 100 causes the conveying velocity of the document to gradually decrease and temporarily stops the document immediately upstream of the read position. Simultaneously, the controller 100 transmits a registration (document entry) stop signal to the main-body control unit 102 via the I/F circuit 101.

Upon receiving a read-start signal from the main-body control unit 102, the controller 100 controls the reading motor 124 and the read entry motor 128 so that the document is conveyed at a gradually-increasing conveying velocity to the read position and passes over the read position at the predetermined velocity.

The controller 100 transmits a gate signal indicating an effective image area on the front side of the document in the sub-scanning direction to the main-body control unit 102 at timing, which is calculated from a pulse count of the read entry motor 128, when the leading end of the document is to reach the read position. The gate signal is kept to be transmitted until the document has passed over the read position.

During one-sided reading, the controller 100 controls the document ejecting motor 125 so that the document ejecting rollers 53 are driven when the document ejection sensor 107 detects a leading end of a document that has passed over the read position. The controller 100 controls the document ejecting motor 125 at timing immediately before a trailing end of the document is to exit a nip between the document ejecting rollers 53. This timing is calculated based on a pulse count of the document ejecting motor 125 that is counted since the leading end of the document is detected by the document ejection sensor 107. Thus, the conveying velocity of the document during ejection is decreased and adjusted so as to prevent the document from going out of the tray 12*a*.

During two-sided reading, the controller 100 transmits a gate signal, that indicates an effective image area on the back side of the document in the sub-scanning direction, to the main-body control unit 102 at timing when the leading end of the document is to reach the reading unit 36. This timing is calculated from a pulse count of the reading motor 124 that is counted since the leading end of the document is detected by the document ejection sensor 107. The gate signal is kept to be transmitted until the document has passed beneath the reading unit 36.

Figure 8:
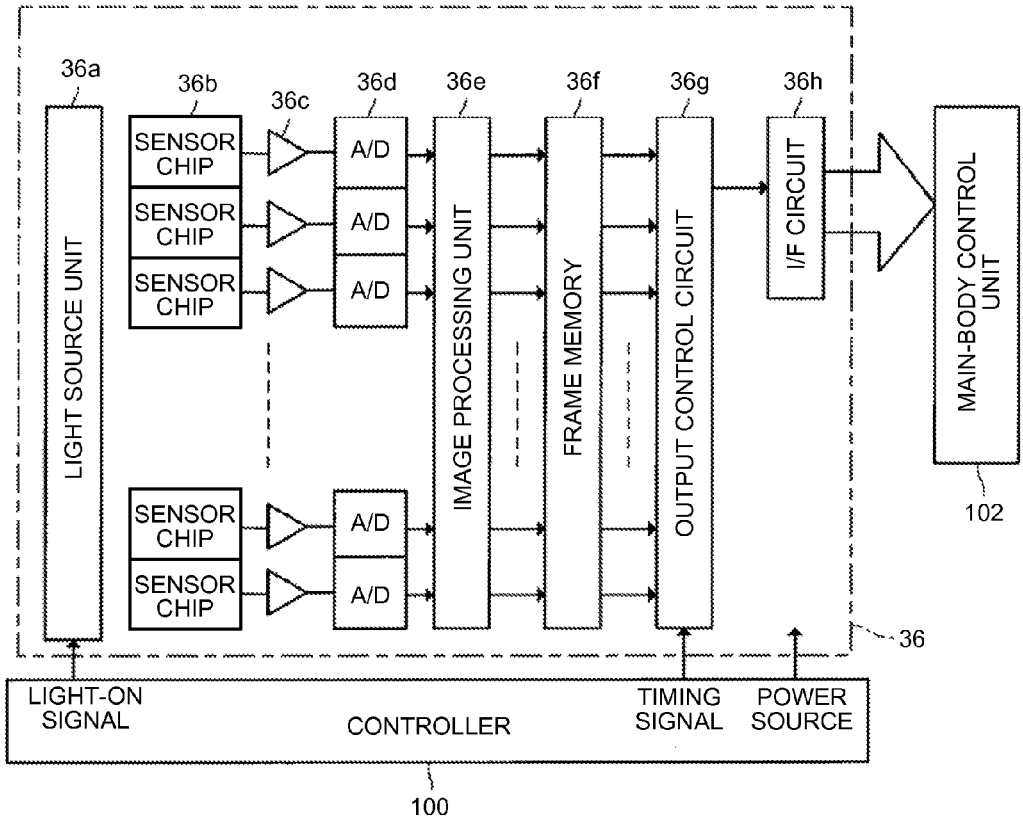
FIG. 8 is a block diagram illustrating a configuration of a reading unit of the ADF according to the embodiment.

FIG. 8 is a diagram illustrating an example configuration of the reading unit 36 that is controlled by the controller 100.

The reading unit 36 comprises a contact image sensor (CIS) or the like. The reading unit 36 includes, for example, a light source unit 36*a*, a sensor chip unit 36*b* in which a plurality of sensor chips are linearly arranged, a group of amplifiers 36*c* respectively connected to the sensor chips, a group of analog-digital (A/D) converters 36*d* respectively connected to the amplifiers, an image processing unit 36*e* to which outputs of the A/Ds are to be fed, a frame memory 36*f* to which an output of the image processing unit 36*e* is to be fed, an output control circuit 36*g* to which an output of the frame memory 36*f* is to be fed, and an I/F circuit 36*h* for allowing the output control circuit 36*g* to output image data to the main-body control unit 102.

The controller 100 supplies power source to the reading unit 36, a light-on signal to the light source unit 36*a*, and a timing signal to the output control circuit 36*g*.

The reading unit 36 optically reads a back side of a document as the document is conveyed in the conveying direction to obtain image data representing a document image on the back side of the document.

Control performed by the controller 100 and relating to open/close detection of the pressure plate unit 20 is described below.

Figure 9:
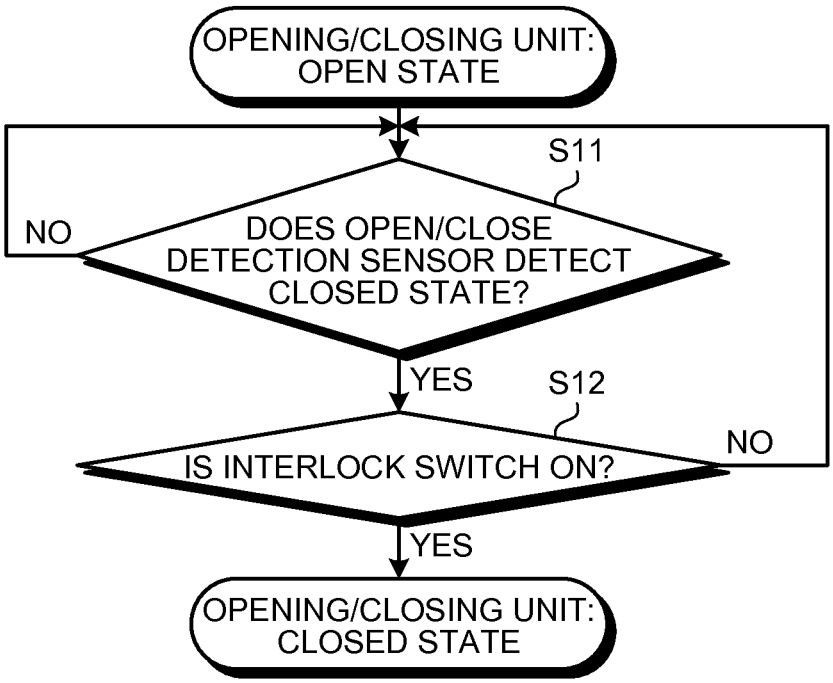
FIG. 9 is a flowchart for describing a procedure for open/close detection in a situation where the pressure plate unit of the ADF according to the embodiment is in an open state.

FIG. 9 is a flowchart of a procedure, in which the pressure plate unit 20 is determined as being in the closed state.

As illustrated in FIG. 9, if the pressure plate unit 20 is in the open state, for example, the controller 100 obtains a detection output of the open/close detection sensor 73 first (Step S11). When the open/close detection sensor 73 is detecting the open state, the controller 100 determines that at least the pressure plate unit 20 is in the open state. In this case, the controller 100 performs control so as to block supply of the first voltage of 24 volts DC to the drive-system motor M.

If the open/close detection sensor 73 is detecting the closed state, the controller 100 obtains a detection output of the interlock switch 72 (Step S12). If the interlock switch 72 is off, the controller 100 determines that at least the document feed cover 81 is in the open state, and repeats the procedure of Steps S11 and S12.

On the other hand, if the interlock switch 72 is on, the controller 100 determines that both the document feed cover 81 and the pressure plate unit 20 are in the closed state. In this case, the controller 100 performs control so that the first power source V1 is supplied to the drive-system motor M.

Meanwhile, it is necessary for the sake of safety that the interlock switch 72 should be switched off when, no matter how slightly, the pressure plate unit 20 is open. However, the ADF 5 configured to satisfy this requirement can encounter a situation that, in a state where the pressure plate unit 20 is slightly open, although the interlock switch 72 is off, nevertheless the open/close detection sensor 73 is detecting the closed state. If, in this case, the condition of the pressure plate unit 20 is determined only based on open/close detection by the open/close detection sensor 73, even though the controller 100 determines that the pressure plate unit 20 is closed, the power source is not supplied to the drive-system motor M because the interlock switch 72 is off. In such a case, even when an attempt of starting the conveyance is made, the motors will not run, which can undesirably lead a user to make a wrong determination that paper jam has occurred or that the ADF 5 is anomalous.

However, according to the embodiment, the controller 100 determines that the pressure plate unit 20 is in the closed state only when both the open/close detection sensor 73 and the interlock switch 72 are on as illustrated in FIG. 9. As a result, it becomes possible to avoid the undesirable situation that the first power source V1 cannot be supplied to the drive-system motor M even though the pressure plate unit 20 is in the closed state.

In the embodiment described above, the interlock switch 72 and the interlock switch 82 are connected electrically in series between the first power source V1 and the drive-system motor M.

Therefore, even when the interlock switch 72 is on, so long as the interlock switch 82 is off, the first voltage of 24 volts DC is not supplied to the terminal 72*a* of the interlock switch 72. Accordingly, the controller 100 can correctly determine that the document feed cover 81 and/or the pressure plate unit 20 is in the open state.

As described above, in a situation where the document feed cover 81 is in the open state, supply of the first voltage of 24 volts DC to the drive-system motor M can be blocked. Accordingly, even when the closed state of the pressure plate unit 20 is erroneously detected, user safety is not adversely affected.

Figure 10:
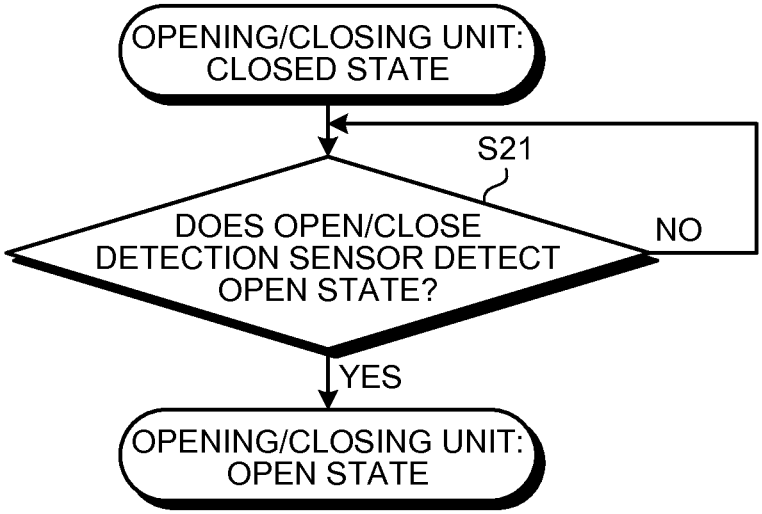
FIG. 10 is a flowchart for describing a procedure for open/close detection in a situation where the pressure plate unit of the ADF according to the embodiment is in a closed state.

FIG. 10 is a flowchart of a procedure, in which the pressure plate unit 20 is determined as being in the open state.

As illustrated in FIG. 10, if the pressure plate unit 20 is in the closed state, for example, the controller 100 obtains a detection output of the open/close detection sensor 73 (Step S21).

If the open/close detection sensor 73 detects that the pressure plate unit 20 is in the closed state, the controller 100 holds this detection output of the open/close detection sensor 73.

On the other hand, in the step S21, if the open/close detection sensor 73 detects that the pressure plate unit 20 is in the open state, the controller 100 determines that the pressure plate unit 20 is in the open state.

The procedure illustrated in FIG. 10 is characterized in that, in contrast to the procedure illustrated in FIG. 9, the pressure plate unit 20 is determined as being in the open state using only the open/close detection sensor 73. The procedure illustrated in FIG. 10 allows avoiding an undesirable situation, which can occur when the open state of the pressure plate unit 20 is determined by both the interlock switch 72 and the open/close detection sensor 73, that the pressure plate unit 20 is erroneously detected as being in the open state. This undesirable situation can occur in the following manner: when the interlock switch 82 is switched off, the voltage supply to the interlock switch 72 is blocked, whereby the interlock switch 72 is switched off; as a result, the pressure plate unit 20 is erroneously detected as being in the open state.

When the interlock switch 82 is on, the open/closed state of the pressure plate unit 20 can be determined without obtaining an output, which indicates on/off, of the open/close detection sensor 73 by determining the open/closed state of the pressure plate unit 20 using only the interlock switch 72.

As described above, the first power source V1 is supplied to the drive-system motor M only when both the interlock switch 72 and the open/close detection sensor 73 detect that the pressure plate unit 20 is closed.

More specifically, in the ADF 5 including the open/close detection sensor 73 and the interlock switch 72 and configured to use the interlock switch 72 also as a switch for detecting the open/closed state of the pressure plate unit 20, the first power source V1 is suppliable to the drive-system motor M only when both a condition that the interlock switch 72 is on and a condition that the open/close detection sensor 73 detects that the pressure plate unit 20 is in the closed state are satisfied. Therefore, it becomes possible to prevent occurrence of an undesirable situation that, in a case where the open/closed state of the pressure plate unit 20 is erroneously detected, the ADF 5 is misjudged to be possibly malfunctioning or the like. As a result, reliability of the ADF 5 can be increased.

The process described above is not necessarily performed in conjunction with jam recovery, and can be performed in a like manner when, for instance, a book or a document is manually placed on the exposure glass 3*b* of the image reading device 3 or during maintenance.

Although the above embodiment is described by way of example where the image forming apparatus including the ADF is implemented as the copier, but not limited thereto. For instance, the ADF is also applicable to an image reading device of a facsimile, a multifunction peripheral, a scanner, or the like.

The number, locations, and the like of the interlock switches and the open/close detection sensor are not limited by the embodiment.

There can be employed a configuration, in which the controller 100 determines that the pressure plate unit 20 is in the open state when a condition, in which the interlock switch 72 is switched off and the open/close detection sensor 73 is detecting the closed state, is maintained longer than a predetermined period of time.

Meanwhile, in a case where a condition, in which any one of the interlock switch 72 and the open/close detection sensor 73 is off, is maintained longer than the predetermined period of time, there is a possibility that the pressure plate unit 20 is in a halfway-closed state (ajar state). Accordingly, there can be employed a configuration that, by monitoring occurrence of this condition, prompts a user via the operation panel to completely close the pressure plate unit 20.

There can be employed a configuration in which the first power source V1 is connected to the interlock switch (upstream side) and the drive-system motor M is connected to the interlock switch 82 (downstream side).

In any one of the configurations, when the document feed cover 81 is in the open state, the first voltage of 24 volts DC from the first power source V1 is not supplied to the interlock switch 72 irrespective of the open/closed state of the pressure plate unit 20. Even when the document feed cover 81 is in the closed state, if the pressure plate unit 20 is in the open state, the first voltage of 24 volts DC is not supplied; the first voltage of 24 volts DC is supplied only when both the document feed cover 81 and the pressure plate unit 20 are in the closed state. Accordingly, in a situation where the document feed cover 81 is in the closed state, open/close detection of the pressure plate unit 20 can be performed only by detecting on/off of the interlock switch 72 of the pressure plate unit 20 (without using the detection output of the open/close detection sensor 73).

In the embodiment described above, the controller 100 may be configured to monitor an on/off order. More specifically, when the pressure plate unit 20 exits the open state and enters the closed state, the on/off order is such that the interlock switch 72 is switched on first, and thereafter the open/close detection sensor 73 is switched on; reversely, when the pressure plate unit 20 exits the closed state and enters the open state, the on/off order is such that the open/close detection sensor 73 is switched off first, and thereafter the interlock switch 72 switched off. In a case where the on/off order is reversed, it is conceivable that deformation of the plate 71 (e.g., the pressing plate 71*b* and/or the blocking plate 71*c* is broken or worn out), breakdown of equipment, such as a sensor, or an anomaly has occurred. Therefore, the embodiment may be configured so as to notify a user about occurrence of the anomaly or the like via the operation panel.

According to an aspect of an embodiment, there is provided an ADF capable of resolving a trouble that can occur when both an open/close detection sensor and an interlock switch are mounted on the ADF and that can arise from erroneous detection of an open/closed state of an opening/closing unit, thereby increasing reliability of the ADF, an image reading device including the ADF, and an image forming apparatus including the same.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An automatic document feeder that includes a document tray unit on which original document sheet are placed and feeds the original document sheets placed on the document tray unit one sheet by one sheet and conveys the document sheet to a predetermined read position on a document glass by motive power supplied from a driving motor, the automatic document feeder comprising:

an opening/closing unit configured to be operable to open and close relative to the document glass;

an open/close detection sensor configured to detect an open/closed state of the opening/closing unit;

a first interlock switch arranged between a power source and the driving motor, the first interlock switch being configured to be on when the opening/closing unit is in the closed state and be off when the opening/closing unit is in the open state; and a control circuit configured to determine the open/closed state of the opening/closing unit based on a detection output of the first interlock switch and a detection output of the open/close detection sensor, wherein the control circuit determines that the opening/closing unit is in the closed state when the first interlock switch is on and the open/close detection sensor is detecting the closed state.

2. The automatic document feeder according to claim 1, wherein the control circuit determines that the opening/closing unit is in the open state when the open/close detection sensor is detecting that the opening/closing unit is in the open state.

3. The automatic document feeder according to claim 1, further comprising a notification unit for notifying a user about an anomaly of the automatic document feeder, wherein the control circuit notifies via the notification unit that the opening/closing unit is in a halfway-closed state when a condition, in which only any one of the detection output of the open/close detection sensor and the detection output of the first interlock switch is off, is maintained longer than a predetermined period of time.

4. The automatic document feeder according to claim 3, wherein the control circuit determines whether equipment is anomalous by monitoring an order, in which the detection outputs of the open/close detection sensor and the first interlock switch change, and, upon determining that an anomaly has occurred, notifies about occurrence of the anomaly via the notification unit.

5. The automatic document feeder according to claim 1, further comprising a document-feed cover unit configured to be operable to open and close relative to a body of the automatic document feeder; and a second interlock switch arranged between the power source and the driving motor and connected to the first interlock switch in series, the second interlock switch being configured to be on when the document-feed cover unit is in a closed state and be off when the document-feed cover unit is in an open state.

6. The automatic document feeder according to claim 5, wherein when a detection output of the second interlock switch is on, the control circuit determines the open/closed state of the opening/closing unit based on the detection output of the first interlock switch.

7. An image reading device comprising a document glass and an automatic document feeder that includes a document tray unit on which original document sheets are placed and feeds the original document sheets placed on the document tray unit one sheet by one sheet and conveys the document sheet to a predetermined read position on the document glass by motive power supplied from a driving motor, wherein the automatic document feeder comprising:

an opening/closing unit configured to be operable to open and close relative to the document glass;

an open/close detection sensor configured to detect an open/closed state of the opening/closing unit;

a first interlock switch arranged between a power source and the driving motor, the first interlock switch being configured to be on when the opening/closing unit is in the closed state and be off when the opening/closing unit is in the open state; and a control circuit configured to determine the open/closed state of the opening/closing unit based on a detection output of the first interlock switch and a detection output of the open/close detection sensor, wherein the control circuit determines that the opening/closing unit is in the closed state when the first interlock switch is on and the open/close detection sensor is detecting the closed state.

8. An image forming apparatus comprising an image reading device including a document glass and an automatic document feeder that includes a document tray unit on which original document sheets are placed and feeds the original document sheets placed on the document tray unit one sheet by one sheet and conveys the document sheet to a predetermined read position on the document glass by motive power supplied from a driving motor, and an image recording device that forms the document image on a recording paper sheet according to an image obtained from a document image on the document sheet by the image reading device, wherein the automatic document feeder comprising:

an opening/closing unit configured to be operable to open and close relative to the document glass;

an open/close detection sensor configured to detect an open/closed state of the opening/closing unit;

a first interlock switch arranged between a power source and the driving motor, the first interlock switch being configured to be on when the opening/closing unit is in the closed state and be off when the opening/closing unit is in the open state; and a control circuit configured to determine the open/closed state of the opening/closing unit based on a detection output of the first interlock switch and a detection output of the open/close detection sensor, wherein the control circuit determines that the opening/closing unit is in the closed state when the first interlock switch is on and the open/close detection sensor is detecting the closed state.

* * * * *